US006372163B1

(12) United States Patent
Boucherie

(10) Patent No.: US 6,372,163 B1
(45) Date of Patent: Apr. 16, 2002

(54) METHOD OF ENDROUNDING LOOSE FIBERS

(75) Inventor: Bart Gerard Boucherie, Izegem (BE)

(73) Assignee: G. B. Boucherie N. V. (BE)

( * ) Notice: Subject to any disclaimer, the term of this patent is extended or adjusted under 35 U.S.C. 154(b) by 0 days.

(21) Appl. No.: 09/463,978

(22) PCT Filed: Aug. 8, 1998

(86) PCT No.: PCT/EP98/05130

§ 371 Date: Feb. 14, 2000

§ 102(e) Date: Feb. 14, 2000

(87) PCT Pub. No.: WO99/07255

PCT Pub. Date: Feb. 18, 1999

(30) Foreign Application Priority Data

Aug. 12, 1997 (GB) ..... 9717112

(51) Int. Cl.[7] ..... A46D 9/02; B24B 9/20; B29C 35/02

(52) U.S. Cl. ..... 264/68; 264/138

(58) Field of Search ..... 264/68, 138

(56) References Cited

U.S. PATENT DOCUMENTS 2,554,777 A * 5/1951 Dangin ..... 264/68
2,587,792 A * 3/1952 von Sivers ..... 219/383
5,007,686 A * 4/1991 Klein et al. ..... 300/21
5,893,612 A * 4/1999 Boucherie ..... 300/2

FOREIGN PATENT DOCUMENTS

DE 44 41 985 A1 5/1996
DE 29614118 U1 * 2/1997
EP 0346646 A2 * 12/1989

* cited by examiner

*Primary Examiner*—Leo B. Tentoni
(74) *Attorney, Agent, or Firm*—Nixon Peabody LLP; Stuart Friedman

(57) ABSTRACT

For implant molding of toothbrushes pre-cut and pre-rounded fiber of thermoplastic material are used. Loose fibers are presented to an endrounding tool in a tuft or bundle and the free ends of the fibers are exposed to a working surface of the tool. Relative movement between the fiber ends and working surface causes the material of the fibers to be heated by friction of a predetermined intensity. The fibers while they are exposed to the working surface of the tool are permitted to flex laterally and are held in an axial direction of the tuft or bundle with their free ends commonly defining a surface different from a plane which is perpendicular to the axial direction, thereby achieving a substantially consistent flexing resistance throughout the cross-section of the tuft or bundle with respect to lateral deflection upon engagement by the endrounding tool.

10 Claims, 3 Drawing Sheets

METHOD OF ENDROUNDING LOOSE FIBERS

The present invention relates to a method of endrounding loose fibres of thermoplastic material for use in brush making, toothbrush making in particular.

BACKGROUND OF THE INVENTION

Brushes for dental or cosmetical use must have bristles with rounded free ends to avoid injury or harm to the user. Rounding of the bristle ends is done after the bristles have been attached to a brush body by means of abrasive methods or radiation. According to a more recent technology, bristles are implant-molded with the brush body. This technology permits the use of pre-cut and pre-rounded fibre, avoiding a finishing step after the bristles have been attached to the brush body. It is more convenient to process the fibre for the purpose of endrounding before attachment to the brush body than performing the finishing steps with the bristles already attached to the brush body.

When an abrasive endrounding method is used, it is mandatory to have the free ends of the fibre perfectly aligned in a plane perpendicular to the length of the tuft or bundle presented to the working surface of the endrounding tool. This requirement has been recognized and confirmed in the patent literature, for example EP 0 346 646 B1. Unless this requirement is satisfied, the fibre ends are not consistently rounded and smoothened from all sides. Also, the amount of fibre that can be processed in a single step is limited because the fibre ends must be free to be laterally deflected so that the fibre end surface can be presented to and engaged by the working surface of the endrounding tool from all sides and directions.

Recently, a new endrounding technology has been proposed wherein a perfect and consistent rounding quality is achieved by producing friction rather than abrasion between the working surface of the endrounding tool and the free ends of the fibres. As disclosed in endrounding tool and the free ends of the fibres. As disclosed in German Utility Model 296 14 118 the rounding effect achieved with this technology is not completely understood, but relative speed between the fibre ends and the working surface is an essential parameter. Relative speed must produce friction in an amount sufficient to heat the thermoplastic material of the fibre close to its melting point, but excessive heat would destroy the fibre ends. This technology has been successfully used on tufts of bristles attached to toothbrush bodies so that the bristles (or fibres) were exposed to the working surface of the endrounding tool in relatively small tufts. It was considered impossible to process large amounts of bristles or fibres in a bundle because of the expected concentration of friction and heat in the central portion of the plane in which the free ends of the fibres are exposed. Such concentration of friction, and thus heat, in the central portion of the bundle is due to the increased lateral support of the fibres in the central portion against deflection by engagement with the endrounding tool. The fibre in the center portion of the bundle is stiffer because it is supported laterally by surrounding fibre. Therefore, a uniform distribution of heat throughout the cross-section of the bundle cannot be achieved. As mentioned earlier, however, the new endrounding technology requires consistent heating conditions within close limits. A similar rounding technique is disclosed in U.S. Pat. No. 2,554,777 where the fibres are processed while they are mounted on a brush.

SUMMARY OF THE INVENTION

The present invention provides a method of endrounding loose fibres of thermoplastic material for use in brushmaking wherein the new endrounding technology relying on friction rather than abrasion can be used and relatively large amounts of fibre can be processed at one time. According to the invention, the fibres are presented to an endrounding tool in a tuft or bundle of relatively large diameter, and the free ends of the fibres are exposed to the working surface of the tool to produce relative movement between the fibre ends and the working surface, causing the material of the fibres to be heated by friction of a predetermined intensity. While the fibres are exposed to the working surface of the tool, they are permitted to flex laterally and are held in an axial direction of the tuft or bundle with their free ends commonly defining a surface different from a plane which is perpendicular to the axial direction. Since the fibres have their ends lying in a plane different from a plane which is perpendicular to the individual fibre can be adjusted in a manner to achieve consistent frictional heating throughout the cross-section of the tuft or bundle. Specifically, in the preferred embodiment the fibres have a cantilever length which is greater close to the centre of the tuft or bundle than closer to its periphery. From a geometrical point of view, the fibres have their free ends located in a surface of convex shape. The convex shape can be conical, frustroconical or hemispherical.

BRIEF DESCRIPTION OF THE DRAWINGS

Further features and details of the invention will become apparent from the following description of several embodiments with reference to the drawings. In the drawings:

FIG. 1 shows the usual configuration of a cylindrical bundle of fibre the free ends of which define a plane perpendicular to the axial direction of the bundle. With this configuration, endrounding of the fibre is possible using a conventional abrasive method.

Figure 3:
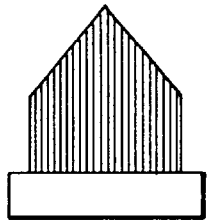

In the configuration of FIG. 3, the free ends of the fibres in the bundle define a surface of conical shape.

DESCRIPTION OF THE PREFERRED EMBODIMENTS

Figure 1:
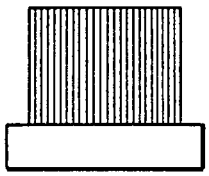
FIGS. 1, 2 and 3 shows three possible configurations of a bundle of fibre to be presented to an endrounding tool.
Figure 2:
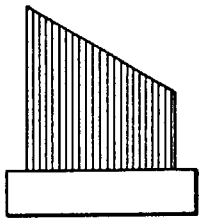
Figure 4:
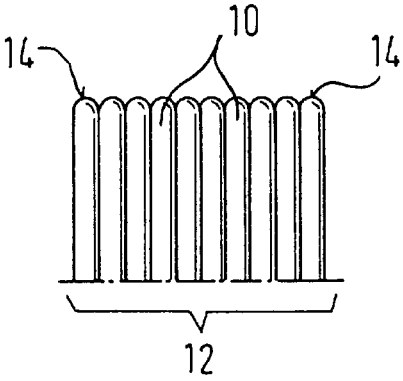
FIG. 4 is an enlarged partial view of the configuration in FIG. 1.
Figure 5:
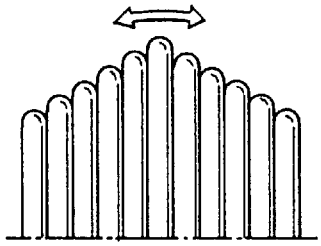
FIG. 5 is an enlarged partial view of the configuration in FIG. 3.

Referring now to FIGS. 4 and 5, it will be seen in FIG. 4 that those fibres 10 in bundle 12 which are closer to the centre portion of the bundle are supported laterally by a greater number of surrounding fibres than those fibres 14 closer to the periphery of the bundle 12. Therefore, fibres which are closer to the periphery oppose less deflection resistance to an endrounding tool passing over the free ends of the fibre. It should be understood that, as seen in FIGS. 1, 2 and 3, the bundle is clamped radially at a predetermined distance from the free ends of the fibre so that each fibre can be deflected laterally upon engagement with the working surface of the endrounding tool. In the conical configuration shown in FIG. 5, the fibres in the central portion of the bundle have a greater cantilever length than those closer to the periphery. Remembering that, in accordance with the theory of strength of materials, the lateral deflection is calculated by the cantilever beam formula $$f=F\cdot l^3/3\cdot E\cdot I$$

in which:

f=sideways displacement of the fibre tip

F=force exerted on the end of the strand l=length of the fibre strand

E, I=constants for a given material and beam section it is easily seen that the greater deflection resistance of the fibres in the centre portion of the bundle due to lateral support by a greater number of surrounding fibres can be compensated by a greater cantilever length of the fibres in the central portion of the bundle. In the preferred embodiment, each fibre end in the bundle has a cantilever length determined to provide substantially consistent flexing resistance throughout the cross-section of the bundle with respect to lateral deflection upon engagement by the endrounding tool.

While the above requirement is best satisfied with the conical configuration shown in FIG. 3, it is possible to use the configuration of FIG. 2 where the free ends of the fibres define a plane inclined to a plane perpendicular to the axial direction of the bundle.

Figure 6:
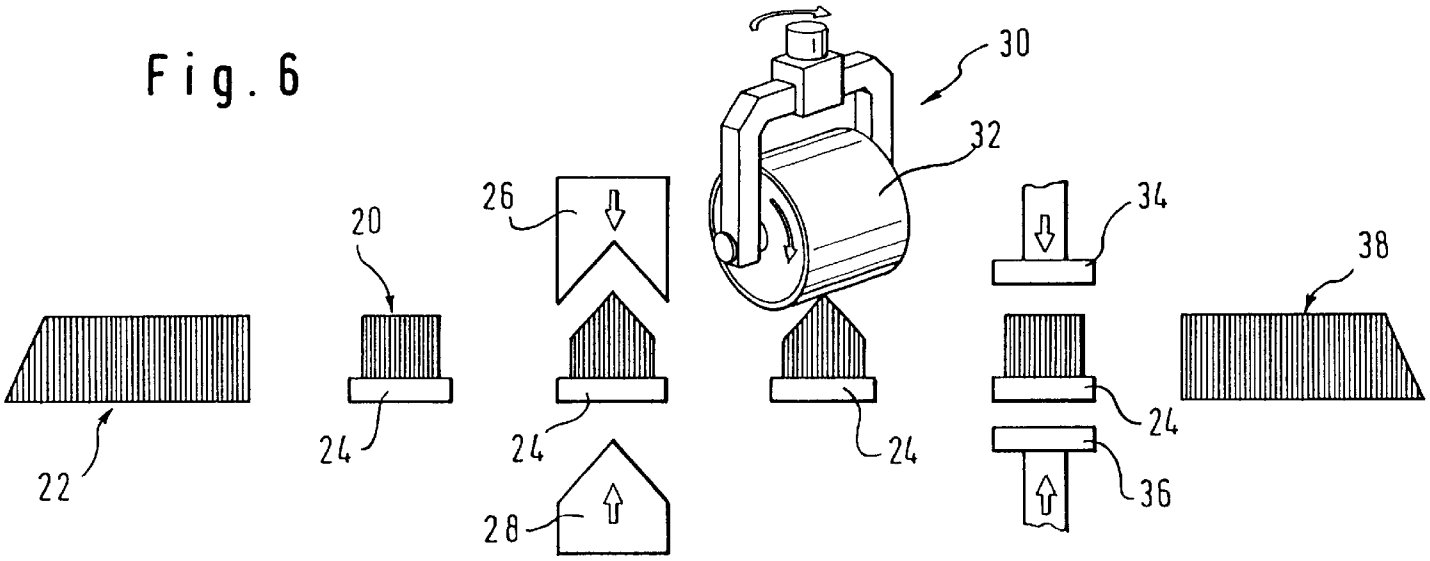
FIGS. 6, 7 and 8 are schematic illustrations of three embodiments of the new endrounding method.

In the method illustrated at FIG. 6, individual tufts or bundles 20 are picked from a supply 22 of pre-cut packed and parallel fibre. The tuft or bundle 20 is clamped radially and thus held axially in a clamp 24. Clamp 24 with the tuft or bundle 20 engaged therein is then moved between a pair of complementary plungers 26, 28, and clamp 24 is released. As seen in the drawings, plungers 26, 28 have complementary concave and convex profiling faces. When plungers 26, 28 are engaged with the axial ends of the tuft or bundle 20 while clamp 24 is released, the fibres are shifted axially with respect to each other, resulting in a configuration similar to that shown in FIG. 3. Clamp 24 is then engaged again and moved to an endrounding tool 30. Endrounding tool 30 has a rotating cylinder 32 defining a working surface which has frictional rather than abrasive properties. Details on the nature and material of the endrounding tool are found in German Utility Model No. 296 14 118. It should be noted here that the rotational speed of cylinder 32 is substantially in excess of that for similar endrounding tools which are abrasive in nature. Also, an important aspect of the endrounding tool is that cylinder 32 has an envelope of a material which produces friction and frictional heat upon contact with the free ends of fibres of thermoplastic material. Finally, it is important to have this coating of cylinder 32 thermally decoupled from the body of cylinder 32 so that the body of cylinder 32 does not form a heat sink. The shape of the endrounding tool is not critical. For example, a rotating disc could be used.

Although a single endrounding tool is shown in the drawings, the preferred method uses a plurality of processing steps. In each processing step, the free ends of the fibres in the bundle or tuft are exposed to a rotating endrounding tool.

After the last processing step has been completed, clamp 24 is moved to a discharge station where clamp 24 is released. The axial ends of the fibres are now engaged between a pair of plungers 34, 36 which have opposed flat alignment surfaces. The rounded ends of the processed fibres are now aligned in a plane, and the fibres are discharged in a box 38 containing finished fibres ready to be used in an implant-molding method where they are attached to a brush body while the brush body is injection-molded.

Figure 7:
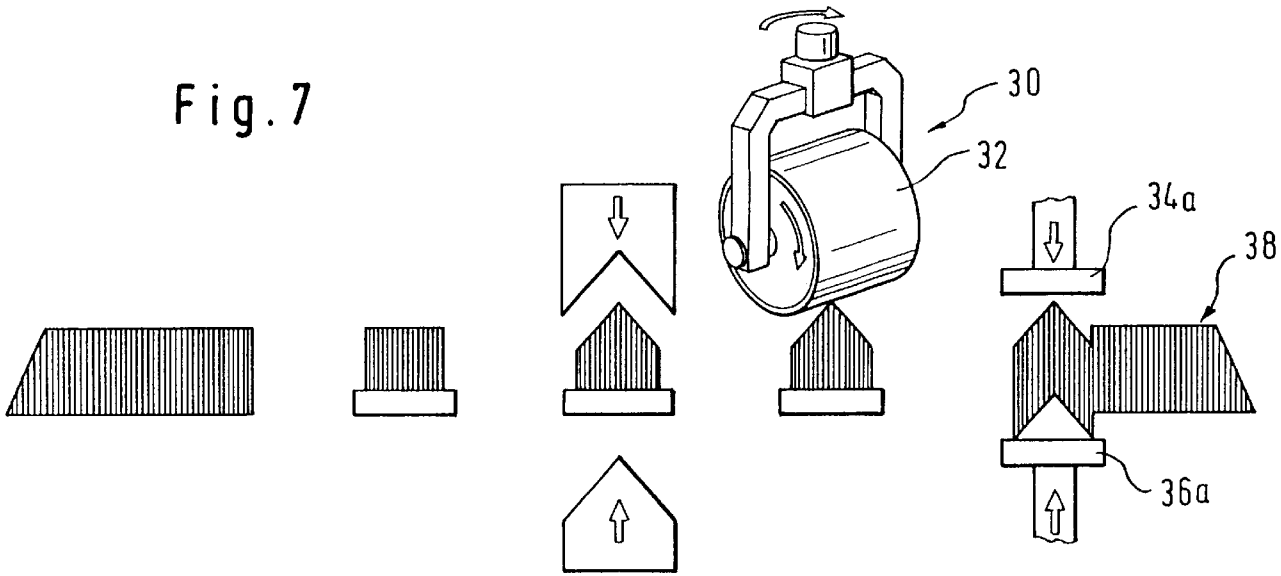

The embodiment in FIG. 7 differs from that of FIG. 6 only in that plungers 34*a*, 36*a* with tapping plates are used to align the finished fibres within box 38.

Figure 8:
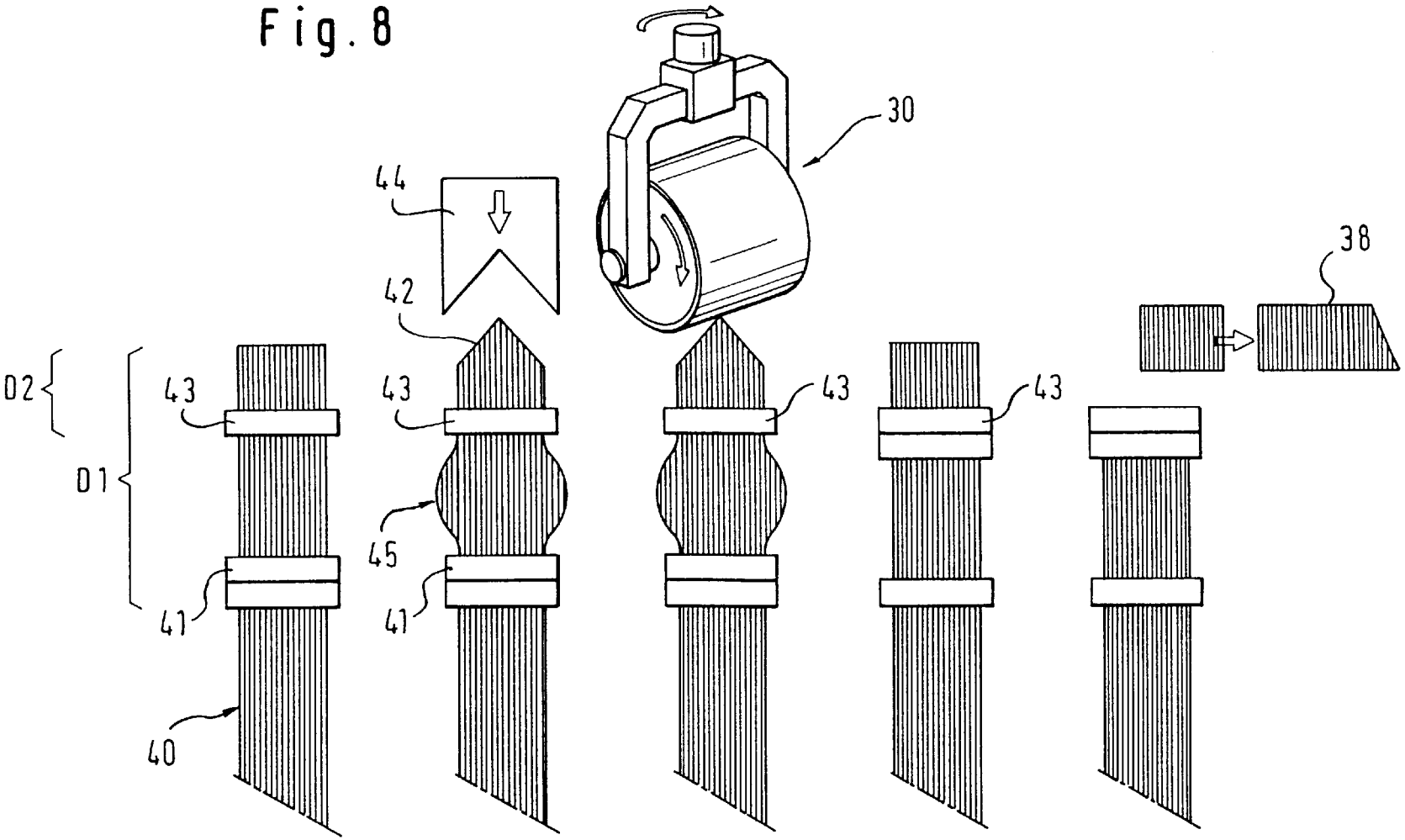

In the embodiment shown in FIG. 8, a continuous strand 40 of parallel fibre is clamped radially by means of a clamp 41 at a first distance D1 from the free ends of the fibres. A second clamp 43 is provided at a second distance D2 from the free ends of the fibres, but released. A profiling member 44 which has a concave conical profiling face is now engaged with the free ends of the fibres at 42 in FIG. 8. The fibres are shifted axially to align their free ends in a surface of the desired conical shape, and the outer fibres of the strand are bulged outwardly, as seen at 45 in FIG. 8. Clamp 43 is now engaged, and the free ends of the fibres are exposed to endrounding tool 30 as in the methods of FIGS. 6 and 7. After all processing steps have been completed clamp 43 is released and the desired length of endrounded fibre is cut from the strand 40 and then moved to fibre box 38.

What is claimed is:

1. A method of endrounding fibers of thermoplastic material for use in brush making, the fibers being presented to an endrounding tool in a tuft and the free ends of the fibers being exposed to a working surface of the tool, the fibers being held in an axial direction of the tuft with their free ends commonly defining a surface different from a plane which is perpendicular to the axial direction and being permitted to flex laterally while they are exposed to the working surface of the tool, said tuft of fibers exceeding the amount of fibers needed for a brush to be made being picked from a supply of packed pre-cut fiber, the relative movement between the ends of the fibers of the tuft and the working surface of the tool causing the material of the fibers to be heated by friction of a predetermined intensity, and said fibers being deposited in a container containing endrounded fiber.

2. A method of endrounding fibers of thermoplastic material for use in brush making, the fibers being presented to an endrounding tool in a tuft and the free ends of the fibers being exposed to a working surface of the tool, the fibers being held in an axial direction of the tuft with their free ends commonly defining a surface different from a plane which is perpendicular to the axial direction and being permitted to flex laterally while they are exposed to the working surface of the tool, a continuous strand of parallel fiber being clamped radially at a first distance from the free fiber ends while they are aligned in a plane, the free ends being engaged by a profiling member having a profiling face corresponding to the shape of surface defined by the free ends of the fibers to shift the fibers axially with respect to each other until the free ends of the fibers define the surface, the tuft being clamped radially at a second distance from the free fiber ends which is smaller than the first distance, the relative movement between the fiber ends and the working surface of the tool causing the material of the fibers to be heated by friction of a predetermined intensity, the strand being released at the second distance from the free fiber ends to allow the fibers to shift axially with respect to each other to align their axial ends in a plane perpendicular to their length, a length of fiber including the free fiber ends being cut from the strand of fiber, and the cut fiber lengths being deposited in a container containing endrounded fiber.

3. The method of claim 1 or 2, wherein the fibers have a cantilever length which is greater in portions of the surface defined by the free ends of the fibers closer to the center of the tuft then in portions closer to the outer edge of the surface defined by the free ends of the fibers.

4. The method of claim 1 or 2, wherein the surface defined by the free ends of the fibers has a convex shape.

5. The method of claim 1 or 2, wherein the surface defined by the free ends of the fibers has a conical shape.

6. The method of claim 1 or 2, wherein the surface defined by the free ends of the fibers is a plane inclined to a plane perpendicular to said axial direction.

7. The method of claim 1 or 2, wherein each fiber end in the tuft has a cantilever length determined to provide substantially consistent flexing resistance throughout the cross-section of said tuft with respect to lateral deflection upon engagement by said working surface of the tool.

8. The method of claim 1 or 2, wherein said working surface of said tool is cylindrical.

9. The method of claim 1 or 2, wherein at least one axial end face of said tuft is engaged by a profiling member having a profiling face corresponding to the shape of the surface defined by the free ends of the fibers to shift the fibers axially with respect to each other until the free ends of said fibers define the surface defined by the free ends of the fibers, the tuft is clamped radially, the free ends of said fibers are exposed to said working surface of said tool, said tuft is released and said fibers are shifted axially with respect to each other to align their axial ends in a plane perpendicular to their length.

10. The method of claim 1 or 2, wherein the step of exposing the free ends of said fibers to said working surface of the tool is repeated a plurality of times with different working tools.

* * * * *

UNITED STATES PATENT AND TRADEMARK OFFICE

CERTIFICATE OF CORRECTION

PATENT NO. : 6,372,163 B1
DATED : April 16, 2002
INVENTOR(S) : Bart Gerard Boucherie It is certified that error appears in the above-identified patent and that said Letters Patent is hereby corrected as shown below:

Title page,
Item [22], the filing date should be -- August 12, 1998 -- not "August 8, 1998" as shown.

Signed and Sealed this

Twenty-fifth Day of June, 2002

*Attest:*

*Attesting Officer*

JAMES E. ROGAN
*Director of the United States Patent and Trademark Office*